US005123865A

United States Patent [19]

Carley

[11] Patent Number: 5,123,865

[45] Date of Patent: Jun. 23, 1992

[54] BASE FOR FLASHLIGHT BULB

[75] Inventor: James A. Carley, Rolling Hills, Calif.

[73] Assignee: Carley, Torrance, Calif.

[21] Appl. No.: 603,317

[22] Filed: Oct. 25, 1990

[51] Int. Cl.[5] ..... H01R 31/06; H01J 5/50

[52] U.S. Cl. ..... 439/628; 313/318; 313/51

[58] Field of Search ..... 313/318, 51; 439/628

[56] References Cited

U.S. PATENT DOCUMENTS

| | | | |
|---|---|---|---|
| 1,272,126 | 7/1918 | Belmont | 439/628 |
| 4,618,799 | 10/1986 | Carley | 313/318 |
| 4,644,220 | 2/1987 | Carley | 313/318 |

FOREIGN PATENT DOCUMENTS

| | | | |
|---|---|---|---|
| 0301176 | 11/1954 | Fed. Rep. of Germany | 439/628 |

*Primary Examiner*—Palmer C. DeMeo
*Assistant Examiner*—Nimeshumar D. Patel
*Attorney, Agent, or Firm*—Daniel C. McKown

[57] ABSTRACT

A flashlight bulb of the type having a sealed envelope from which two pins extend in parallel relationship can be removably mounted in a PR-type base by the use of an insert that fits within the PR-type base and that includes, in addition to the holes for the pins, balls that are urged laterally against the pins by compression springs within the insert. The balls establish electrical contact with the pins and are connected by conductors to the terminals of the PR-type base.

3 Claims, 2 Drawing Sheets

BASE FOR FLASHLIGHT BULB

BACKGROUND OF THE INVENTION

1. Field of the Invention

The present invention is in the field of electrical apparatus and more particularly relates to a structure that permits a pin-type flashlight bulb to be used in a PR-type base.

2. The Prior Art

The PR-type base is a commercially available standard part, well-known in the industry. That type of base includes a flange that insures proper positioning of the flashlight bulb with respect to the reflector, and it also includes conductive parts which provide an electrical connection between the batteries and the filament.

It is also well-known to manufacture a flashlight bulb in the form of a sealed glass envelope enclosing the filament, with two pins extending from the sealed envelope. The present inventor described such a flashlight bulb in U.S. Pat. No. 4,618,799 issued Oct. 21, 1986.

One way of integrating the envelope with its two extending pins into a PR base is described in U.S. Pat. No. 4,644,220, issued Feb. 17, 1987 to the present inventor. As described in that patent, a specialized insert is secured within the metal shell of the PR-type base, and the pins extending from the sealed envelope are removably inserted into the insert. The insert contained contacts of a resilient material that bore against the pins. The present invention provides a different structure for the insert.

SUMMARY OF THE INVENTION

In accordance with the present invention, the pins that extend from the sealed envelope can be removably inserted into holes in an insert which is permanently secured within a PR-type base. However, in the present invention the insert includes spring-loaded balls that bear against the pins to establish mechanical and electrical contact. Conductors welded to the balls establish a connection between the balls and the electrical terminals of the base.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
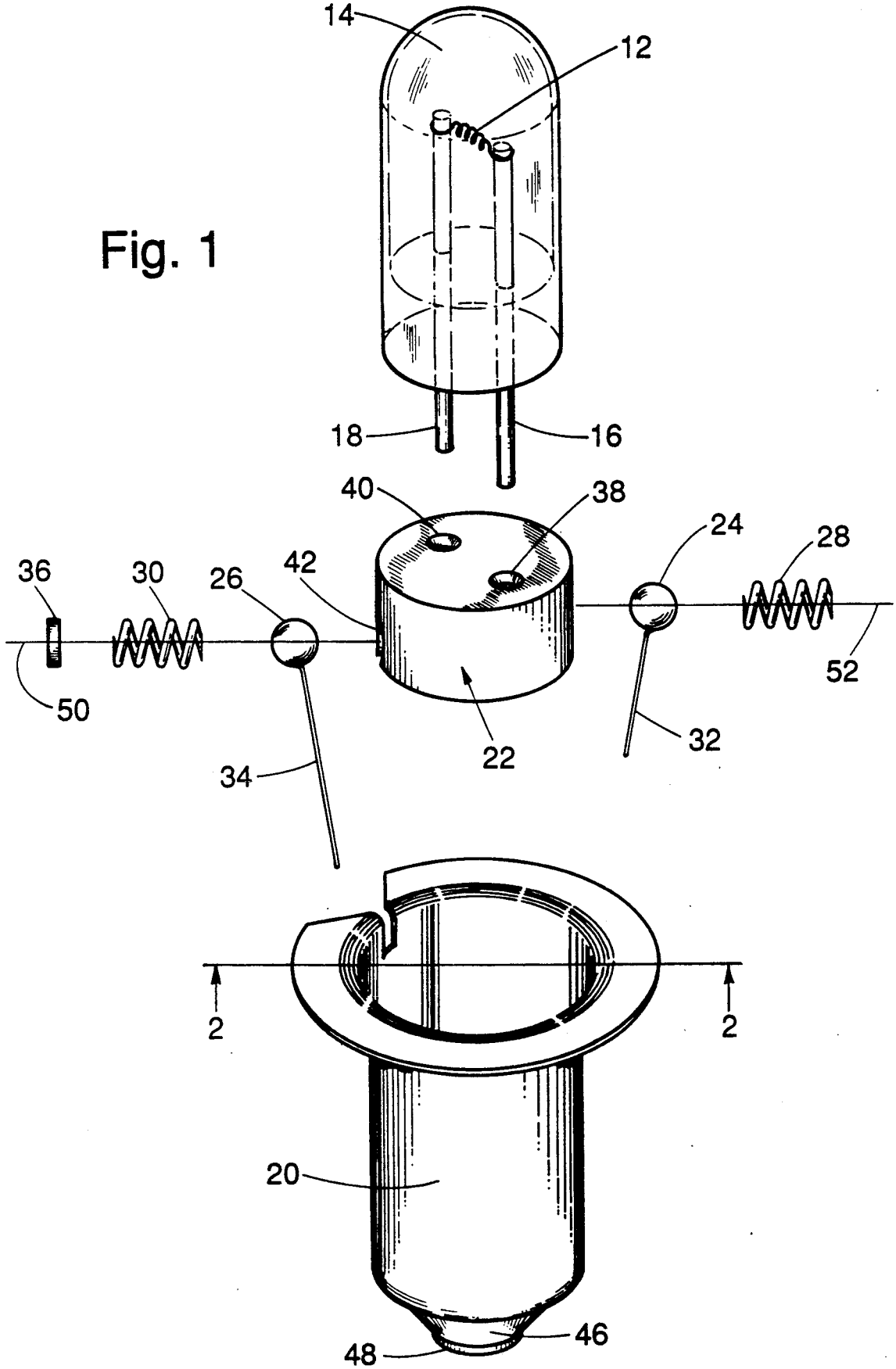
FIG. 1 is an exploded view in perspective showing the parts that make up the invention in a preferred embodiment.
Figure 3:
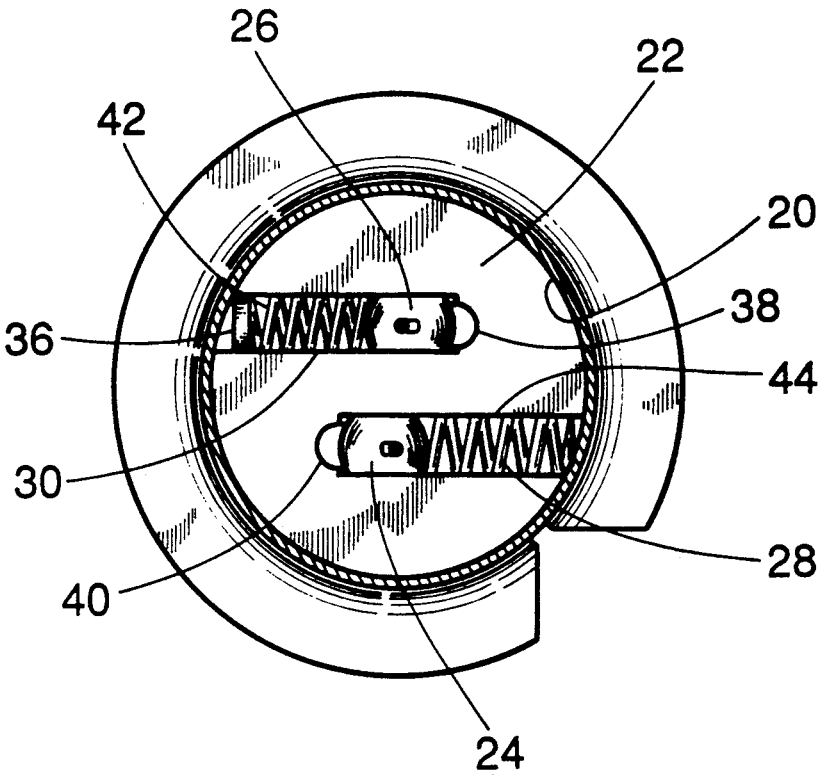
Figure 2:
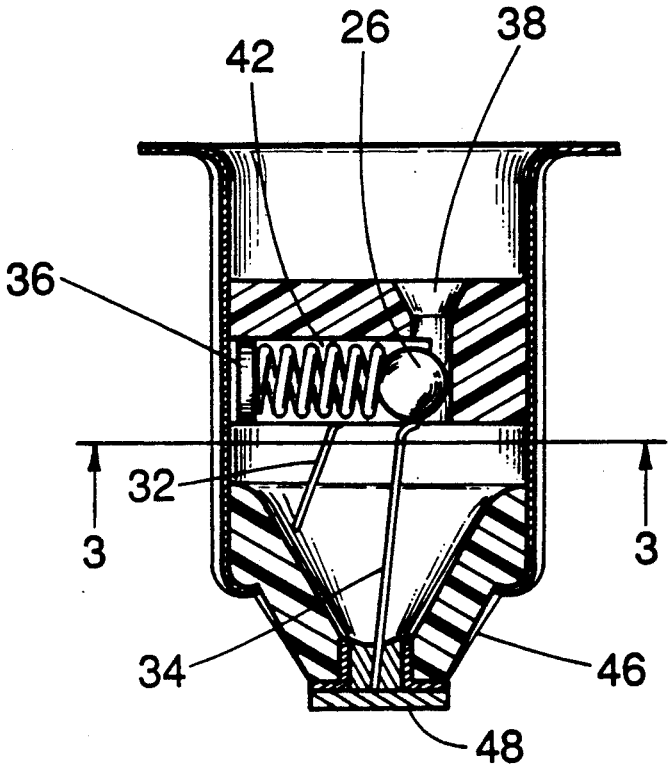
FIG. 2 is a cross-sectional view in the direction 2—2 indicated in FIG. 1 and showing the parts assembled in the PR base; and, FIG. 3 is a cross-sectional view in the direction 3—3 indicated in FIG. 2.

FIGS. 1, 2 and 3 relate to the same preferred embodiment of the invention, and each element is identified by the same reference numeral throughout.

FIG. 1 is an exploded perspective view. The light is produced by the filament 12 that is mounted inside a glass envelope 14 from which the pins 16 and 18 extend. The pins serve to index the position of the filament, and they also serve to conduct electricity to it.

The pins 16 and 18 are inserted into the holes 38 and 40 of the insert 22. In the preferred embodiment, the insert 22 has a cylindrical shape and fits into the outer shell 20 of the PR base in a tight sliding fit. In the preferred embodiment, the insert 22 is composed of a plastic material, and the outer shell 20 is composed of metal.

As best seen in FIG. 3, in addition to the holes 38, 40 that extend through the insert 22 in the preferred embodiment, the insert also includes the blind bores 42 and 44 that extend perpendicular to the holes 38 and 40 respectively and that terminate at the holes 38 and 40. In the preferred embodiment, the blind bores 42, 44 extend in opposite directions at an angle of 45 degrees with respect to an imaginary line drawn between the holes 38 and 40.

The balls 24, 26 are located at the bottoms of the blind bores 44 and 42 respectively. The balls are urged against the bottom of the blind bores by the compression springs 28, 30. In the preferred embodiment, the balls 24, 26 and the compression springs 28, 30 are composed of metal, and to prevent short circuiting of the filament, it is necessary to provide an insulative disc 36 to prevent the spring 30 from making contact with the outer shell 20.

In the preferred embodiment, a conductor 32, welded to the ball 24 at one end, is welded to the outer shell 20, and a conductor 34 welded to the ball 26 is welded at its other end to the electrical terminal 48, which is positioned with respect to the outer shell 20 by the insulative standoff 46.

In an alternative embodiment, the conductor 32, that extends out of the bottom of the insert 22 is bent upward around the outside of the insert 22 so that it becomes jammed between the insert and the outer shell 20 as the insert is pushed into the outer shell during assembly.

Thus, there has been described an insert for permitting a flashlight bulb having pins to be inserted into a PR-type base. The compression springs 28 and 30 continually urge the balls 24 and 26 against the pins 16 and 18, thereby maintaining a good electrical contact and also urging the pins against the walls of the holes 38, 40, thereby increasing the friction between those elements so as to prevent the pins from being dislodged from the holes 38, 40 by shocks and vibrations of the magnitudes encountered in normal use.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is being claimed is:

1. A base for a flashlight bulb of the type in which a filament connected between two pins is enclosed in a sealed envelope from which the two pins extend in spaced parallel relationship, said base comprising:

an outer shell, open at one end;

an insert of such size and shape as to permit it to be inserted into said outer shell with a tight fit, said insert of an insulative material and including two holes for receiving the pins extending from the sealed envelope, said insert further including two blind bores each extending perpendicularly into one of said two holes but no further;

two balls, of a conductive material, one lodged at the bottom of each of said two blind bores;

two compression springs, one within each of said two blind bores, and in a compressed state when said insert has been inserted into said outer shell, said two holes, whereby said two balls yieldingly oppose insertion the two pins into said two holes, and whereby once the two pins have been inserted into said two holes, said two compression springs urge said two balls against the two pins to produce a firm electrical contact between the two pins and said two balls, and to yieldably retain the two pins in said two holes to prevent unintentional withdrawal of the two pins; and, an insulative disk located between a chosen one of said two compression springs and said outer shell when said insert has been seated into said outer shell and preventing electrical contact between the chosen compression spring and said outer shell.

2. The base of claim 1 wherein said outer shell is composed of a conductive material and further comprising:

an electrical terminal;

standoff means for mechanically mounting said electrical terminal to said outer shell while electrically insulating said electrical terminal from said outer shell; and, conductive means electrically connecting one of said two balls to said electrical terminal and the other of said two balls to said outer shell.

3. The base of claim 1 wherein said outer shell includes a portion having a generally cylindrical shape and wherein said insert has a cylindrical shape.

* * * * *